US005678265A

United States Patent [19]

Meyer

[11] Patent Number: 5,678,265

[45] Date of Patent: Oct. 21, 1997

[54] INFLATABLE CUSHION

[76] Inventor: Kenneth G. Meyer, 906 E. Catalina Ave., Santa Ana, Calif. 92706

[21] Appl. No.: 584,243

[22] Filed: Jan. 11, 1996

[51] Int. Cl.[6] ..... A47C 27/10

[52] U.S. Cl. ..... 5/654; 5/708; 5/710; 137/874

[58] Field of Search ..... 5/708, 710, 713, 5/655.3, 654; 297/284.6; 137/874

[56] References Cited

U.S. PATENT DOCUMENTS

| | | | |
|---|---|---|---|
| 1,772,310 | 8/1930 | Hart | 5/713 |
| 2,991,803 | 7/1961 | Michie | 137/874 |
| 2,998,817 | 9/1961 | Armstrong | 5/713 |
| 3,047,020 | 7/1962 | Barrett, Jr. | 137/874 |
| 3,303,518 | 2/1967 | Ingram | 5/710 |
| 3,587,568 | 6/1971 | Thomas | 5/713 |
| 4,225,989 | 10/1980 | Corbett et al. | 5/710 |
| 5,035,016 | 7/1991 | Mori et al. | 5/453 |
| 5,103,518 | 4/1992 | Gilroy et al. | 5/453 |
| 5,267,365 | 12/1993 | Walter | 5/455 |
| 5,277,474 | 1/1994 | Hannagan et al. | 297/284 |
| 5,311,623 | 5/1994 | Hendi | 5/450 |
| 5,345,629 | 9/1994 | Ferrand | 5/453 |
| 5,412,824 | 5/1995 | Emerson et al. | 5/632 |
| 5,502,855 | 4/1996 | Graebe | 5/710 |

FOREIGN PATENT DOCUMENTS

| | | | |
|---|---|---|---|
| 267348 | 12/1968 | Austria | 297/284.6 |

*Primary Examiner*—Alexander Grosz

*Attorney, Agent, or Firm*—Gene Scott; Patent Law & Venture Group

[57] ABSTRACT

An inflatable seating cushion provides intermeshed cell structures so that air pressure changes from one of the cell structures to the next provides for improved comfort during long sitting periods. A manual selection switch allows an inflation means to be interconnected with any one of the cell structures. An alternate inflation fixture provides a means for inflating all of the cell structures simultaneously.

4 Claims, 2 Drawing Sheets

INFLATABLE CUSHION

BACKGROUND OF THE INVENTION

1. Field of the Invention

This invention relates generally to cushions for sitting upon, and more particularly to an improved cushion having alternate inflatable cell structures for providing improved comfort.

2. Description of Related Art

Invention and use of inflatable cushions is known to the public. Mori et al U.S. Pat No. 5,035,016 and Gilroy et al U.S. Pat. No. 5,103,518 both teach variations of a programmable air mattress. Alternate cells are separately inflatable. Walter, U.S. Pat No. 5,267,365 teaches a programmable liquid filled mat. Hannagan et al, U.S. Pat. No. 5,277,474 teaches an air inflated seat pad having programmable filling of alternate cells. Hendi, U.S. Pat. No. 5,311,623 teaches a combination air and water mattress with cells filled with both of these fluids, and having a programmable inflation. Ferrand, U.S. Pat. No. 5,345,629 teaches a complex articulated bed which also includes fluid filled cells with automated pressure variation programming. The prior art does not teach an inflatable portable mat for sitting upon that is easily inflatable between alternate cells, by mouth, or otherwise, in order to provide for improved comfort over extended periods.

The present invention fulfills these needs and provides further related advantages as described in the following summary.

SUMMARY OF THE INVENTION

The present invention is an improved air inflatable cushion or mat having alternate cell structures which are able to be inflated by mouth, or otherwise. A rotatable switch device is provided for selecting which of the alternate cell structures are to be filled. Thus it is an object of the present invention to provide an improved seating cushion inflatable by mouth. It is a further object of the present invention to provide such a seating cushion having alternate inflatable cell structures so that alternate portions of the anatomy are able to be relaxed during prolonged seating periods. It is a further object of the present invention to provide a seating cushion having manual means for changing the portions of the cell structure that are filled with air, or to increase or decrease the amount of air pressure in the various cell structures at will, quickly and easily, and even while sitting upon the cushion.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a seating cushion device. In such drawings.

DETAILED DESCRIPTION OF THE PREFERRED EMBODIMENT

Figures 1, 4:
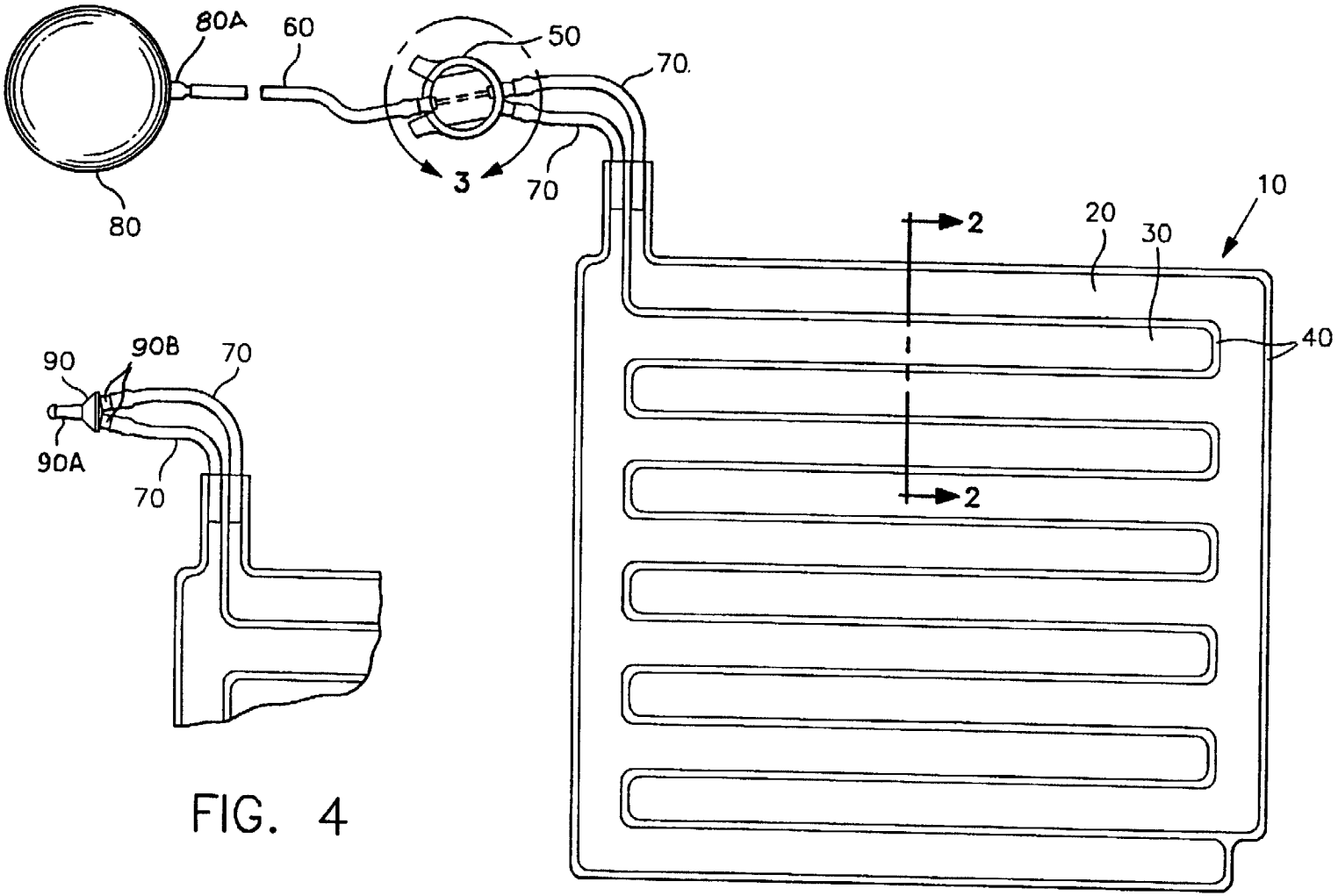
FIG. 1 is a plan view of the preferred embodiment of the present invention, particularly showing a seating cushion with a means for manually filling a plurality of cell structures within.
FIG. 4 is a close-up view of one portion of FIG. 1 showing an alternate filling means.

The above described drawing figures illustrate a seating air cushion device or apparatus. An air cushion 10 provides a plurality of independently inflatable, collapsible, air cell structures 20, 30 in intermeshed arrangement. The preferred arrangement is shown in FIG. 1 where the cushion has a series of parallel, side-by-side inflatable fingers, where alternate fingers are joined for common inflation. A means for inflating the air cell structures 20, 30 is provided, preferably a squeezable air inflation bulb 80 such as is commonly used for inflating inflatables or for blowing air puffs etc. Such a bulb 80 generally has a one-way valve (not shown) so that when the bulb 80 is squeezed, air contained within the bulb is forced out of an outlet aperture 80A. Subsequently, when the bulb 80 is released, the valve closes so that air is sucked into the bulb through an alternate path. An alternate inflation means is a simple straw or tube 60 capable of supporting exhaled air for mouth inflation of the invention. A still further alternate inflation means might include an automatic filling arrangement. Such an arrangement would include a supply of compressed gas and a memos for throttling the gas into one or more of the cell structures. A pressure gauge would be used to control the amount of fill and a microprocessor circuit would be used to control a preset schedule of fills. The apparatus further includes a means for selecting 50 any one of the air cell structures for inflation, while deselecting all other of the air cell structures. Finally, an interconnection means 70 for bringing the selecting means 50 and the inflating means 80 into communication with the air cushion 10 is provided. Such an interconnection means 70 may be simply one or more flexible tubes as best seen in FIG. 1 and FIG. 3.

A preferred alternative inflating means is a rigid fitting 90, as seen in FIG. 4, providing a first tube 90A engagable with any source of air pressure, but preferably, the mouth, and a plurality of second tubes 90B engaged with the interconnection means 70. The first 90A and second 90B tubes are in common communication, as they are preferably constructed as a single molded part so that air introduced into the first tube 90A is directed to the second tubes 90B.

Figure 3:
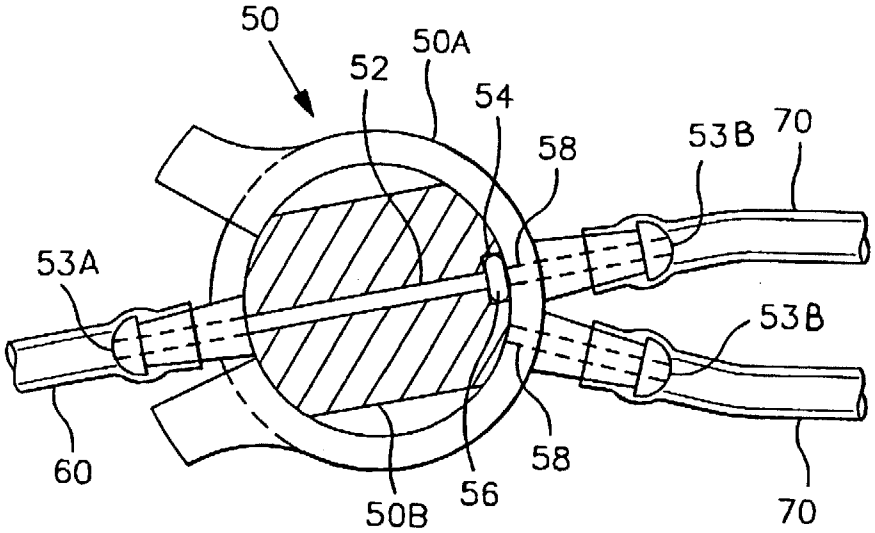
FIG. 3 is a plan view particularly showing construction details of a switching member of the invention, which is shown in cross-section, and a frame member within which the switching member rotates.

As shown in FIG. 3 the selecting means 50 preferably comprises a switching member 50B held within a fixed annular frame member 50A. The switching member 50B is rotatable within the frame member 50A. The switching member 50B provides an air inlet 53A joined with a passage 52 through the switching member 50B. Rotation of the switching member 50B provides alignment and interconnection of the passage 52 with any one of plural air outlets 53B in the frame member 50A so that air introduced in the air inlet 53A is directed to the selected one of the plural air outlets 53B. Because the switching member 50A is in intimate contact with the frame member 50A, it is not possible for air in the non-selected air outlet 53B to escape, since the switching member 50B blocks the non-selected air outlets 53B. The passage 52 may provide a wide mouth portion 54 for accepting an o-ring 56 for better sealing the interconnection between the passage 52 and the channel 58 of the selected air outlet 53B. The preferred intermeshed arrangement of the cell structures provide a side-by-side series of alternating inflated and deflated air cell structures 20, 30 in transverse arrangement on the cushion 10.

Figure 2:
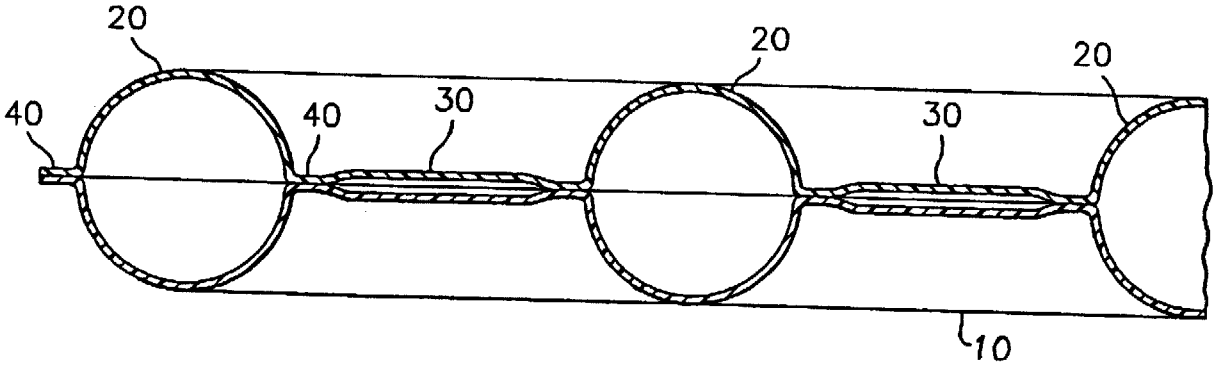
FIG. 2 is a cross-sectional view thereof taken along line 2—2 of FIG. 1, particularly showing the alternately filled cell structures within the cushion.

In use, the apparatus is inflated as shown in FIG. 2. In the preferred embodiment, the apparatus has an inflated cell structure 20, and a deflated cell structure 30. In practice the cell structures may be fully, partially, or slightly inflated as desired by the user so as to provide comfort, and a change of support in order to prevent soreness, or even loss of blood circulation from sitting too long in one "spot". The apparatus is easily manipulated for making frequent and extensive changes in the support pattern of the cushion 10. Because the independent tube fingers are arranged preferably in a side by side, transverse arrangement, it has been found that the filled tubes tend to rotate slightly when the user moves or adjusts body position. Because of the rotation, massage action is delivered to the buttocks area of the user and a change of pressure position tends to prevent blood flow reduction with its attendant problems.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An air cushion apparatus comprising:

a plurality of independent, collapsible and inflatable, air cell structures in intermeshed arrangement, each one of the air cell structures providing a plurality of parallel, mutually communicating, spaced apart portions interlaced in side-by-side arrangement with corresponding portions of each of the other air cell structures, each one of the air cell structures being distributed over the air cushion apparatus so as to, alone, provide effective inflation of the entire air cushion apparatus;

a means for inflating the air cell structures;

a means for selecting any one of the air cell structures for inflation, the selecting means thereby deselecting all other of the air cell structures for deflation thereof; and interconnection means for bringing the selecting means and the inflating means into communication with the air cushion, the selecting means comprising a rotatable switching member held within a fixed annular frame member, the switching member providing an air inlet joined with a passage through the switching member, rotation of the switching member providing alignment and interconnection of the passage with any one of plural air outlets in the frame member so that air introduced in the air inlet is routed to the selected one of the plural air outlets and then to one of the air cell structures.

2. The apparatus of claim 1 wherein the inflating means is a squeezable air inflation bulb.

3. The apparatus of claim 1 wherein the inflating means is a straw for mouth inflation.

4. The apparatus of claim 1 wherein the inflating means is a rigid fitting, the fitting providing a first tube engagable with a source of air pressure, and a plurality of second tubes engaged with the interconnection means, the first and second tubes being in common communication.

* * * * *